US005173200A

United States Patent [19]

Kellett

[11] Patent Number: 5,173,200

[45] Date of Patent: Dec. 22, 1992

[54] LOW-SOLVENT GELLED DRYER-ADDED FABRIC SOFTENER SHEET

[75] Inventor: George W. Kellett, Cranford, N.J.

[73] Assignee: Creative Products Resource Associates, Ltd., Clifton, N.J.

[21] Appl. No.: 783,501

[22] Filed: Oct. 28, 1991

Related U.S. Application Data

[63] Continuation-in-part of Ser. No. 568,836, Aug. 17, 1990, Pat. No. 5,066,413, and Ser. No. 521,242, May 9, 1990, Pat. No. 5,062,973, which is a continuation-in-part of Ser. No. 331,870, Apr. 4, 1989, Pat. No. 4,938,879.

[51] Int. Cl.[5] ..... D06M 10/08

[52] U.S. Cl. ..... 252/8.8; 252/8.6; 252/8.7; 252/8.75; 252/8.9; 427/242

[58] Field of Search ..... 252/8.6, 8.7, 8.75, 252/8.8, 8.9; 427/242

[56] References Cited

U.S. PATENT DOCUMENTS

| | | | |
|---|---|---|---|
| 2,251,328 | 8/1941 | Ehret | 252/134 |
| 3,435,537 | 4/1969 | Rumsey, Jr. et al. | 34/72 |
| 3,442,692 | 5/1969 | Giaser | 117/120 |
| 3,650,816 | 3/1972 | Rudy et al. | 252/8.6 |
| 3,826,682 | 7/1974 | Liebowitz et al. | 117/139.5 |
| 3,896,033 | 7/1975 | Grimm, III | 252/8.8 |
| 3,936,538 | 2/1976 | Marshall et al. | 252/8.8 |
| 3,977,980 | 8/1976 | Fry et al. | 252/8.8 |
| 4,022,938 | 5/1977 | Zaki et al. | 252/8.6 |
| 4,041,205 | 8/1977 | Compa et al. | 252/8.6 |
| 4,049,858 | 9/1977 | Murphy | 252/8.8 |
| 4,077,890 | 3/1978 | Barker | 252/8.8 |
| 4,099,913 | 7/1978 | Walter et al. | 252/8.6 |
| 4,511,495 | 4/1985 | Melville | 252/8.8 |
| 4,514,444 | 4/1985 | Ives et al. | 252/8.6 |
| 4,532,063 | 7/1985 | Gueldenzopf | 252/90 |
| 4,557,852 | 12/1985 | Schulz et al. | 252/8.6 |
| 4,566,980 | 1/1986 | Smith | 252/8.6 |
| 4,581,385 | 4/1986 | Smith et al. | 521/111 |
| 4,889,643 | 12/1989 | Royce et al. | 252/8.8 |
| 4,938,879 | 7/1990 | Kellett | 252/8.75 |

FOREIGN PATENT DOCUMENTS

| | | |
|---|---|---|
| 1017101 | 9/1977 | Canada . |
| 0225848 | 6/1987 | European Pat. Off. . |
| 2416937 | 9/1979 | France . |
| 1598449 | 9/1981 | United Kingdom . |

*Primary Examiner*—Paul Lieberman
*Assistant Examiner*—William S. Parks
*Attorney, Agent, or Firm*—Merchant, Gould, Smith, Edell, Welter & Schmidt

[57] ABSTRACT

A low-solvent fabric-modifier sheet for in-dryer use is provided which comprises water, a polyalkylene glycol, and an amount of an organic gelling agent effective to dimensionally stabilize the sheet, having uniformly distributed in said sheet an effective amount of at least one zwitterionic fabric-softening agent.

15 Claims, No Drawings

LOW-SOLVENT GELLED DRYER-ADDED FABRIC SOFTENER SHEET

This application is a continuation-in-part of U.S. patent application Ser. No. 7/568,836, filed Aug. 17, 1990, and now U.S. Pat. No. 5,066,413, and a continuation-in-part of U.S. patent application Ser. No. 07/521,242, filed May 9, 1990, now U.S. Pat. No. 5,062,973; which is a continuation-in-part of U.S. patent application Ser. No. 07/331,870, filed Apr. 4, 1989, now U.S. Pat. No. 4,938,879.

BACKGROUND OF THE INVENTION

Certain chemical compounds have long been known in the art to possess the desired quality of imparting softness to textile fabrics The quality of "softness" or being "soft" is well defined in the art, and, as used herein, means that quality of the treated fabric whereby its handle or texture is smooth, pliable, and fluffy, and not rough or scratchy to the touch. Known generally as "fabric softeners," these compounds have long been used by homemakers in the laundry, and by the textile industry to soften a finished fabric.

Additionally, many of these compounds act to reduce the "static cling" of the treated fabrics. Static cling is generally the phenomenon of a fabric adhering to another object or to parts of itself as a result of static electrical charges located on the surface of the fabric. It can also cause the adherence of lint, dust, and other undesired substances to the fabric. It is noticeably present in unsoftened fabrics that are freshly washed and dried in an automatic hot air dryer. By softening and reducing the static cling of a fabric, it is more comfortable when worn. Such treated fabrics additionally are easier to iron, and have fewer hard-to-iron wrinkles.

Perhaps the most common fabric conditioners known in the art are cationic compounds, especially amines such as quaternary ammonium and imidazolinium salts. These compounds are widely marketed for home use in the form of liquid emulsions. They must be added to the laundry in the rinse cycle, not the wash cycle, because cationic fabric conditioners interact with substances present in laundry detergents such as anionic surfactants and builder salts, thereby rendering both relatively ineffective. A commercial fabric conditioner of this type is Downy ® (The Procter & Gamble Company, Cincinnati, Ohio).

Another means of providing fabric conditioning is disclosed in Gaiser, U.S. Pat. No. 3,442,692, issued May 6, 1969, incorporated herein by reference, comprising a fabric-conditioning composition in conjunction with a dispensing means for use in a hot air dryer. Preferred articles had the fabric-conditioning composition releasably affixed to an absorbent substrate, such as a nonwoven tissue, in the form of an impregnate or coating of cationic fabric-conditioning agent. The use of certain polyesters, especially sorbitan esters as auxiliary fabric-conditioning agents in products of this kind, is disclosed in Zaki et al., U.S. Pat. No. 4,022,938, issued May 10, 1977, incorporated herein by reference. A commercial product that has utilized the teachings of Gaiser and Zaki et al. is Bounce ®, The Procter & Gamble Company.

Substrates having fabric-conditioning agents adhered to substrates formed from natural or synthetic organic polymers have also been disclosed. For example, Schulz et al., U.S. Pat. No. 4,557,852, disclose a water-soluble sheet formed from a synthetic acrylate-type polymer which encloses a fabric softener or a bleach. This laundry care additive is added to the washing machine. Marshall et al., U.S. Pat. No. 3,936,538, disclose a fabric-softening composition for use in the dryer consisting of a sheet of a film-forming polymer having a molecular weight of at least 100,000, a fabric softener and a surfactant. However, these compositions leave a "crumpled sheet residue behind" in the dryer.

Compa et al. (U.S. Pat. No. 4,041,205) discloses a fabric softening sheet which is composed of 10–99% of the fabric softening agent which is reinforced with 1–40% of cellulose, microcrystalline protein or nylon fibers so that it maintains its integrity prior to addition to the laundry in the dryer. Compa et al. also disclose that the sheets can be reinforced with gums or solid organic polymers. These necessarily release large amounts of residue, since neither the fibers nor the polymeric reinforcing agents will evaporate during use.

Therefore, both the "absorbent substrate" and "all-chemical" type in-dryer softeners disclosed hereinabove can leave a powdered, solid or gummy residue or a residual base sheet which must be removed following the completion of the drying cycle. These sheets may be reusable to some extent, but the user has no way to readily determine whether or not sufficient softener is retained on the base sheet. Furthermore, although these products are easy to dispense, their efficacy depends on the efficient release of the fabric conditioner from a substrate which does not participate in the softening process, and which may itself decompose to soil the dried laundry. Also, in-dryer sheets generally do not soften as well as liquids, since the sheets may not contact all of the laundry evenly during the drying process. This can also lead to staining of the laundry due to the uneven release of the softener.

Commonly-assigned U.S. Pat. No. 4,938,879 and U.S. patent applications Ser. Nos. 7/521,242, filed May, 1990 and 7/568,836 filed Aug. 17, 1990 all disclose a sheet for in-dryer use formed by gelling a mixture of water and an organic solvent such as a glycol ether, with a fatty acid salt to form a dimensionally-stable matrix sheet. The sheet can act as a carrier for various fabric modifying agents such as quaternary amine fabric softening agents. When added to a rotary hot air dryer along with damp laundry, the sheet readily disintegrates as the matrix evaporates, leaving the laundry softened and no visible residue in the dryer.

Although these sheets are a marked improvement over earlier attempts to provide in-dryer softening, the use of large amounts of volatile organic solvent, e.g., 40–60% in the sheets disclosed in U.S. Pat. No. 4,938,879 can pose both an environmental risk due to the release of relatively large amounts of solvent. Also, such high-solvent sheets yield a gelled matrix that can be unacceptably brittle, thus increasing the processing and packaging difficulties associated with their manufacture, and making them difficult for the consumer to handle.

Therefore, there is a continuing need for a solid fabric softening sheet for use in an automatic hot air clothes dryer which is convenient to use, which softens effectively without leaving a residue in the dryer, and which does not stain or otherwise soil the dried laundry.

BRIEF DESCRIPTION OF THE INVENTION

The present invention provides a fabric modifier comprising a gelled sheet that imparts softening, antistatic and/or other desirable properties to laundry while leaving no significant residue in the dryer after use therein. The sheet comprises about 40–70% water, about 10–30% of a water-miscible solvent selected from the group consisting of a liquid polyalkylene glycol, a liquid methoxypolyalkylene glycol and mixtures thereof, and an effective gel-forming amount of an organic gelling agent such as a fatty acid salt. Uniformly distributed throughout said sheet is an effective amount of one or more fabric-softening agents, such as the preferred zwitterionic fabric-softening agents, or "betaines."

Preferably, the sheets will also comprise a minor amount of one or more adjuvant surfactants to enhance the dispersal of the sheet in the dryer.

The present modifier sheets are dimensionally stable, so that they can be readily dispensed by the user and added to the dryer in discrete units, along with, prior to, or after adding wet, laundered clothing or other laundered items. However, during drying of the laundry, the gelled solvent matrix evaporates, or otherwise disperses, and the modifiers are spread evenly onto the fabrics. No, or an insignificant residue from the present sheets, remains in a conventional rotary hot air dryer following exposure to a laundry drying cycle, so there is nothing for the user to remove but the dried laundry, which has been uniformly softened, rendered static-free, or otherwise modified, without being stained. As used herein, the term "insignificant" means that less than 5%, preferably less than 1%, and most preferably, 0% by weight of each sheet used, remains in the dryer after the laundry has been dried, either as free matter, or adhered to the dryer surface. The term "about" as it relates to the amounts of ingredients used to formulate the sheets relates, in part, to the errors in actual weights due to uncertainties in measurement, and to the amount of active ingredient present in proprietary formulations.

Therefore, the invention is also directed to a method for depositing fabric-modifying agents such as softening agents on fabrics in a rotary hot air dryer comprising placing one or more of the present sheets in the dryer with the wet fabrics, and operating the dryer to dry the fabrics. The term "laundry" or "fabrics" encompasses not only clothing, but other items which are commonly cleaned via household or institutional laundering, including sheets, draperies, rugs, upholstery coverings, towels and the like. As used herein, the term "dryer" refers to a rotary hot air dryer, which tumbles the clothes in a drum with hot air, usually at a temperature of about 40°–90° C., preferably at about 50°–95° C.

Since the gelled lattice of the present sheets is thermally unstable in that it disintegrates, solubilizes in the latent water carried in the wet laundry, and disperses when exposed to the elevated temperature in the dryer, the present sheets are fundamentally different from the water-soluble polymeric sheets disclosed by Schulz et al. or Marshall et al., hereinabove, which are intended to provide a thermally-stable matrix to protect and/or deliver fabric conditioning or laundry care additives. However, since the present sheets are water-soluble, they can be used in the washing machine as well. The present sheets also do not incorporate a water-insoluble support or reinforcing matrix of any type, e.g., of water-insoluble plastic, foam or textile. The present sheets differ from those disclosed by Compa et al. in U.S. Pat. No. 4,041,205, by employing large amounts of water in combination with a volatile liquid polyalkylene glycol and by employing fatty acid salts to form the gelled matrix of the sheets.

Although the present invention is exemplified primarily as a sheet which delivers one or more zwitterionic "betaine" fabric-softening agents, the invention is also intended to encompass a sheet which can deliver a wide variety of fabric-treating agents or fabric-modifying agents. For example, an effective amount of one or more fabric-modifying agents selected from the group consisting of anti-creasing agents, anti-soil agents, anti-static agents, bacteriostatic agents, brightening agents, bodying agents, dyes, odor-masking agents and fragrances, fiber emollients, finishing agents, germicides, lubricants, mildew- or moth-proofing agents, shrinkage controllers, sizing agents, and mixtures thereof can be uniformly distributed throughout the present sheet, in conjunction with, or in place of, the fabric-softening agent. When formulated in this manner, the present sheet is referred to as a "fabric modifier" or "fabric-modifying sheet" instead of as a "fabric softener" or "fabric-softener sheet".

Therefore, the present invention also includes a fabric modifier comprising a gelled sheet formed by a process comprising the steps of (a) forming a uniform liquid dispersion of at least one fabric-modifying agent and an organic gelling agent in mixture of 40–70% water and 5–30% of a liquid polyalkylene glycol or a liquid methoxypolyalkylene glycol; and (b) forming the dispersion into a dimensionally stable gelled sheet, preferably by the use of 5–15% of a fatty acid salt.

The present invention also provides a method for depositing a fabric-modifying agent on fabrics in a rotary hot air dryer comprising placing the present fabric modifier in the dryer with wet fabrics, and operating the dryer to dry the fabrics.

A further aspect of the present invention is a base sheet comprising a gelled sheet which comprises 40–70% water, 5–30% of a water-miscible polyalkylene glycol or methoxypolyalkylene glycol, and an effective gel-forming amount of a fatty acid. This is the base or carrier sheet for the fabric-modifying agent or agents.

DETAILED DESCRIPTION OF THE INVENTION

The present sheets are preferably prepared by forming a uniform, heated liquid dispersion of at least one fabric-modifying agent such as a betaine, a nonionic surfactant, an organic gelling agent and, optionally, fragrance, in about 5–30% of at least one water-miscible liquid polyalkylene glycol; and cooling and forming said mixture into a dimensionally stable gelled sheet.

Fabric Softening Agent

The present modifier sheet gels will preferably include an amount of one or more fabric-softening agents uniformly dispersed throughout the body of the sheet. Many useful fabric-softening agents are known to the art, and are disclosed, for example, in U.S. Pat. Nos. 4,041,205, 3,936,538, 4,566,980 and 4,581,385, disclosures of which are incorporated by reference herein.

Although a wide variety of classes of fabric softening agents and compatible mixtures thereof can be employed in the present invention, some of which can function as anionic, cationic or nonionic surfactants, or vice-versa, it is especially preferred to employ an effective fabric-softening amount of at least one zwitterionic (or "inner salt") fabric softening agent. Betaines, or the inner carboxylate salts of quaternary amines, have been found to increase the dimensional stability of the sheets by increasing their resistance to tearing and their flexibility. This class of softening agent is also preferred due its biodegradability.

Preferred among these are the derivatives of a dilower alkyl glycine, in the betaine form. Such glycine derivatives are of the formula

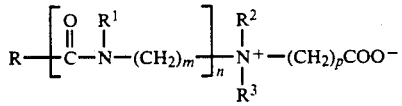

wherein R is higher ($C_{10}$–$C_{20}$) fattyalkyl or monounsaturated ($C_{10}$–$C_{20}$) alkenyl, $R^1$ is hydrogen, ($C_1$–$C_3$-)alkyl or hydroxy($C_1$–$C_3$)alkyl and $R^2$ and $R^3$ are ($C_1$–$C_3$) alkyls. The subscripts m, n and p are numbers from 1 to 5, 0 or 1, and 1 to 3, respectively. The higher alkyls R, or acyls,

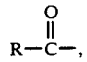

are of 10 to 20 carbon atoms, e.g., lauroyl, myristyl palmitoyl, palmityl, stearoyl, stearyl, oleyoyl and the like. $R^1$ is usually hydrogen by may also be lower alkyl, preferably of 1 to 3 carbon atoms, such as methyl, ethyl, n-propyl and isopropyl or 2-hydroxy-ethyl while $R^2$ and $R^3$, which may be same or different, are lower alkyls, also preferably of 1 to 3 carbon atoms, such as those described for $R^1$. The most preferred alkyl for $R^2$ and $R^3$ is methyl. Although m may be such as to produce an alkylene, e.g., methylene, ethylene, propylene, butylene or amylene, it has been found that the propylene embodiment, wherein m is 3, is preferred when n is 1. Whether n is 0 or 1, it is also preferable that p be 1, although ethylene and propylene radicals also may usefully connect the nitrogen and the acyl carbon of the dimethyl glycine moiety.

Preferred betaines of this structural class include the N-(carboxymethyl)-N,N-dimethyl-N-($C_{10}$–$C_{20}$)(alkyl or alkenyl) aminium hydroxide inner salts such as oleyl betaine (Velvetex OLB-50, Henkel), coco-betaine myristyl betaine, lauryl betaine and the like. In the above formula: n-0, p=1, $R^2=R^3=CH_3$ and R is a ($C_{10}$–$C_{20}$)alkyl or ($C_{10}$–$C_{20}$)alkenyl moiety. Cocoamidoethyl betaine (Standamox CAW, Henkel) and cocamidopropyl betaine (Velvetex BC-35, Henkel, along with other ($C_{10}$–$C_{20}$)alkylamido (($C_2$–$C_3$)alkyl) betaines can also be used, wherein the "betaine" moiety is the unit $—N^+(CH_3)_2CH_2CO_2^-$. Other useful zwitterionic fabric softeners are disclosed in Marshall et al. (U.S. Pat. No. 3,936,538).

Surfactant

One or more surfactants can optionally be used in the present modifier sheets, to assist in the formation of a uniform liquid dispersion which is the precursor of the present sheets, and to assist the dispersal of the sheets in the dryer. Nonionic surfactants are preferred for use in the present invention and can also act as adjunct fabric softeners. Minor but effective amounts of certain anionic surfactants may also be useful in the present invention to provide improved water-solubility and faster dissipation of the sheets in the dryer.

Useful nonionic surfactants include the condensation products of ethylene oxide with a hydrophobic polyoxyalkylene base formed by the condensation of propylene oxide with propylene glycol. The hydrophobic portion of these compounds has a molecular weight sufficiently high so as to render it water-insoluble. The addition of polyoxyethylene moieties to this hydrophobic portion increases the water-solubility of the molecule as a whole, and the liquid character of the product is retained up to the point where the polyoxyethylene content is about 50% of the total weight of the condensation product. Examples of compounds of this type include certain of the commercially-available Pluronic® surfactants (BASF Wyandotte Corp.), especial those in which the polyoxypropylene ether has a molecular weight of about 1500–3000 and the polyoxyethylene contact is about 35–55% of the molecule by weight, i.e., Pluronic® L-62.

Preferred nonionic surfactants include the condensation products of $C_8$–$C_{22}$ alkyl alcohols with 2–50 moles of ethylene oxide per mole of alcohol. Examples of compounds of this type include the condensation products of $C_{11}$–$C_{15}$ fatty alcohols with 3–50 moles of ethylene oxide per mole of alcohol which are commercially available from Shell Chemical Co., Houston, Tex., as, i.e., Neodol® 23–6.5 ($C_{12}$–$C_{13}$ fatty alcohol condensed with about 7 moles of ethylene oxide), the PolyTergent® SLF series from Olin Chemicals or the Tergitol® series from Union Carbide, i.e., Tergitol® 15-S-15, which is formed by condensing about 15 moles of ethylene oxide with a $C_{11}$–$C_{15}$ secondary alkanol; Tergitol® TMN-6, which is the condensation product of about 6 moles of ethylene oxide with isolauryl alcohol (CTFA name: isolaureth-6), Incropol® CS-12, which is a mixture of stearyl and cetyl alcohol condensed with about 12 moles of ethylene oxide (Croda, Inc.) and Incropol® L-7, which is lauryl alcohol condensed with about 7 moles of ethylene oxide (Croda, Inc.).

Preferred nonionic surfactants also include $C_8$–$C_{24}$) fatty acid amides e.g., the monoamides of a mixture of arachidic and behenic acid (Kenamide® B, Humko Chem. Co., Memphis, Tenn.), and the mono- or dialkanolamides of ($C_8$–$C_{22}$) fatty acids, e.g., the diethanol amide, monoethanol amide or monoisopropanolamide of coconut, lauric, myristic or stearic acid, or mixtures thereof. For example, Monamide® S is the monoethanol amide of stearic acid (Mona Industries, Inc., Patterson, N.J.) and Monamide® MEA is the monoethanol amide of coconut acid (Mona).

Other nonionic surfactants which may be employed include the ethylene oxide esters of ($C_6$–$C_{12}$ alkyl phenols such as (nonylphenoxy)polyoxyethylene ether. Particularly useful are the esters prepared by condensing about 8–12 moles of ethylene oxide with nonylphenol, i.e., the Igepal® CO series (GAF Corp., New York, N.Y.).

Other useful nonionics include the ethylene oxide esters of alkyl mercaptans such as dodecyl mercaptan polyoxyethylene thioether, the ethylene oxide esters of fatty acids such as the lauric ester of polyethylene glycol, i.e., PEG 600 monostearate (Akzo Chemie) and the lauric ester of methoxypolyethylene glycol; the ethylene oxide ethers of fatty acid amides, the condensation products of ethylene oxide with partial fatty acid esters of sorbitol such as the lauric ester of sorbitan polyethylene glycol ether, and other similar materials, wherein the mole ratio of ethylene oxide to the acid, phenol, amide or alcohol is about 5–50:1.

Useful anionic surfactants are known to the art, including ethoxylated alcohol sulfates, sodium alkyl sulfates, alkyl sulfonates, sodium alkyl benzene sulfonates and sodium or potassium alkyl glyceryl ether sulfonates. The anonionic surfactant may be optionally added in minor but effective amounts, e.g., up to about 1%, in addition to the optional nonionic or amphoteric surfactant, in order to enhance the water-solubility of the present sheets. However this class of surfactant is generally not employed with betaines or with cationic quats.

Another broad class of surfactants are cationic, and can be referred to as quaternary amine salts, or "quats." These materials also can function to condition the dried fabrics and to reduce static cling and lint adherence. The fabrics are softened in that their sheen, loft, and/or hand-feel is improved by either subjective or objective evaluation.

Subclasses of these materials are referred to by the art as monomethyl trialkyl quaternaries, imidazolinium quaternaries, dimethyl alkyl benzyl quaternaries, dialkyl dimethyl quaternaries, methyl dialkoxy alkyl quaternaries, diamido amine-based quaternaries and dialkyl methyl benzyl quaternaries wherein the "alkyl" moiety is preferably a ($C_8$–$C_{24}$)alkyl group and the quaternary (amine) is a chloride or methosulfate salt.

For convenience, one subclass of alphatic quaternary amines may be structurally defined as follows:

$$(R)(R_1)(R_2)(R_3)N^+X^-$$

wherein R is benzyl, or lower(alkyl) benzyl; $R_1$ is alkyl of 10 to 24, preferably 12 to 22 carbon atoms; $R_2$ is $C_{10}$–$C_{24}$-alkyl, $C_1$–$C_4$-alkyl, or ($C_2$–$C_3$)hydroxyalkyl, $R_3$ is $C_1$–$C_4$-alkyl or ($C_2$–$C_3$)hydroxyalkyl and X represents an anion capable of imparting water solubility or dispersibility including chloride, bromide, iodide, sulfate and methosulfate. Particularly preferred species of these aliphatic quats include n-$C_{12}$–$C_{18}$-alkyl-dimethylbenzylammonium chloride (myrisalkonium chloride), n-$C_{12}$–$C_{14}$-alkyldimethyl(ethylbenzyl) ammonium chloride (quaternium 14), dimethyl(benzyl) ammonium chloride, lauryl (trimethyl)ammonium chloride and mixtures thereof. These compounds are commercially available as the BTC series from Onyx Chemical Co., Jersey City, N.J. For example, BTC 2125M is a mixture of myrisalkonium chloride and quaternium-14. Dihydro-genated tallow methyl benzyl ammonium chloride is available as Variquat® B-343 from Sherex Chem. Co., Dublin, Ohio.

Other useful aliphatic quats include those wherein both R and $R_1$ are ($C_8$–$C_{24}$)alkyl, e.g., the N,N-di-(higher)-$C_{10}$–$C_{24}$-alkyl-N,N-di(lower)-$C_1$–$C_4$-alkyl-quaternary ammonium salts such as distearyl(dimethyl)ammonium chloride, dihydrogenated tallow(dimethyl)ammonium chloride, ditallow(dimethyl)ammonium chloride (Arquad® 2HT-75, Akzo Chemie, McCook, Ill.), distearyl(dimethyl)ammonium methylsulfate and dihydrogenated-tallow(dimethyl)ammonium methyl sulfate (Varisoft® 137, Sherex).

Other useful quaternary ammonium antistatic agents include the acid salts of (higher(alkyl)-amido(lower)-alkyl)-dialkyl)-amines of the general formula:

$$[(A(C{=}0)—Y—)—N(R_1)(R_2)(R_3)]^+X^-$$

wherein A is a $C_{14}$–$C_{24}$ normal or branched alkyl group, Y is ethylene, propylene or butylene, $R_1$ and $R_2$ are individually H, $C_1$–$C_4$ (lower)alkyl or ($C_1$–$C_3$)hydroxyalkyl or together form the moiety $—CH_2—CH_2YCH_2—CH_2—$, wherein Y is NH, O or $CH_2$; $R_3$ is the same as $R_1$ or is also [A(C=0)Y—], and X is the salt of an organic acid. Compounds of this class are commercially available from Croda, Inc., New York, N.Y., as the Incromate® series, e.g. Incromate® IDL [isostearamidopropyl(dimethyl)amine lactate], Incromate® ISML [isostearamidopropy(morpholinium)lactate] and Incromate® CDP [cocamidopropyl(dimethyl)amine propionate]. Ditallowdiamido methosulfate (quaternium 53) is available from Croda as Incrosoft® T-75.

Preferred imidazolinium salts include: (methyl-1-tallow-amido)ethyl-2-tallow imidazolinium methyl sulfate; available commercially from Sherex Chemical Co. as Varisoft® 475; (methyl-1-oleylamido)ethyl-2-oleyl imidazolinium methyl sulfate; available commercial from Sherex Chemical Co. as Varisoft® 3690, tallow imidazolinium methosulfate (Incrosoft® S-75, Croda) and alkylimidazolinium methosulfate (Incrosoft® CFI-75, Croda).

Other useful amine salts are the stearyl amine salts that are soluble in water such as stearyl-dimethylamine hydrochloride, distearyl amine hydrochloride, decyl pyridinium bromide, the pyridinium chloride derivative of the acetylaminoethyl esters of lauric acid, decylamine acetate and bis-[(oleoyl)-(5,8)-ethanoloxy]-tallow($C_{14}$–$C_{18}$)aminehydrogen phosphate (Necon® CPS-100) and the like.

Organic Gelling Agent

The present gelled fabric modifier sheets will also include an amount of an organic gelling agent which is effective to gel the liquid dispersions when they are cooled and formed into sheets. Any organic gelling agent or mixture of organic gelling agents can be used which imparts sufficient dimensional stability to the sheets during manufacture, storage and use, and which yields sheets which disperse leaving no significant residue in the dryer after use therein.

Useful gelling agents can include metal complexes of polysaccharide gums, i.e., polysaccharide gums that are gelled in situ by the addition of an effective amount of one or more metal or ammonium cations. Preferred gums for use in the present invention include vegetable gums, such as the alkali metal salts of alginic acid ("alginates"), carrageenan (preferably kappa-carra-geenan), pectin, and mixtures thereof. These "strong gums" regel from solution or dispersion to yield a continuous gel structure which is suitable as the matrix of the invention. The cations which can gel the gums comprise alkali metal, alkaline earth metal or ammonium cations. Useful divalent cationic gelling agents also include copper (II), cadmium (II), barium (II), strontium (II), cobalt (II), nickel (II), zinc (II), manganese (II) and iron (II) cations. Useful trivalent cations include aluminum (III), chromium (III) and iron (III). Preferred water-soluble ionic compounds are selected from pharmaceutically acceptable fluorides, citrates, phosphates, tartrates, sulfates, acetates, borates, chlorides and the like, of cations such as sodium, lithium, potassium, magnesium, calcium and ammonium. Especially preferred are inorganic salts, i.e., chloride salts such as potassium chloride (KCl), calcium chloride ($CaCl_2$) and mixtures thereof.

Preferred organic gelling agents include the alkali earth metal, alkaline earth metal or ammonium salts of various naturally occurring or synthetic fatty acids. Useful fatty acids may be selected from one or more ($C_8$–$C_{22}$) fatty acids which incorporate 0–3 double bonds per fatty acid molecule, e.g., myristic acid, stearic acid, palmitic acid, lauric acid, behenic acid and the like. Alkali metal salts of fatty acids such as stearic acid are preferred. For example, sodium stearate is available from Witco Chem. Co. as Grade T-1. However, the fatty acid salt can be formed in situ in the liquid dispersion, by neutralizing the acid with a base such as an alkali metal hydroxide, e.g., LiOH, KOH, or NaOH, which may be added to the dispersion as an aqueous solution. Likewise, the gelling agent comprising the polysaccharide gum is gelled in situ by addition of an effective amount of a cation.

Other organic polymer adjuvants for use with the gelling agents in minor amounts to strengthen the sheets and increase their flexibility include polyvinylpyrrolidone and polyvinylpyrrolidone/vinyl acetate copolymers, i.e., PVP-VA 335 and E-775 from GAF, Corp., Wayne, N.J., and polymeric organic waxes. Useful polymeric waxes include ethylene acrylate copolymers, ethylene acrylic acid copolymers and polyethylene (e.g., oxidized polyethylenes). These materials are commercially available in the form of aqueous emulsions or dispersions, e.g., from Allied Chemical, Morristown, N.J., as the A-C Copolymer and A-C Polyethylene series, such as A-C Copolymer 540, A-C Copolymer 580 and A-C Polyethylene 617 and 629. Waxy polyethylene glycols (PEG) such as those of a molecular weight of about 800 to 1700–2000 are preferred for use in the present gels. Also useful as strength-enhancing additives are the high molecular weight acrylate copolymers available from the Interpolymer Corporation, Canton, Mass., by the tradenames CX30-67-1 and Syntran ® KL-219-C. These cationic copolymers have the formula $(—CH_2—CH—COOR)_n$, where n is greater than 50 for CX30-67-1, and n is greater than 100 for Syntran KL-219-C.

Solvent System

The present sheets are formed by dispersing the above-described active ingredients in an aqueous solvent system which preferably consists essentially of water and at least one liquid water-miscible poly($C_2$–$C_3$)alkylene glycols such as the liquid polyethylene glycols (PEG), i.e., polyethylene glycol-200, 300, 400 or 600, wherein the suffixed numbers indicate the approximate molecular weight of the glycol. For example, polyethylene glycol of molecular weight 380–420 is available as Carbowax ® Polyethylene Glycol 400 from Union Carbide Chem. Co., Danbury, Conn. Also preferred for use in the present sheets are the water-miscible, liquid methoxypoly($C_2$–$C_3$)alkylene glycols, such as methoxypolyethylene glycols. Representative members of this class of solvent are available from Union Carbide as Carbowax ® MPEG 350 and 550, wherein the suffixed numbers indicate the approximate molecular weight. Useful polyalkylene glycols also include liquid polypropylene glycols or mixed (polyethylene) (polypropylene) glycols which are preferably used in combination with a major proportion of a PEG or methoxy-PEG.

Fragrance

Minor but effective amounts of a volatile odoriferous agent selected so as to be chemically compatible with the above-described materials are preferably included in the sheets to deodorize the fabrics. Useful fragrances include oils such as rose oil, lavender, lilac, jasmine, vanilla, wisteria, lemon, apple blossom, or compound bouquets such as citrus, spice, aldehydic, woody, oriental, and the like.

Formation of Sheet

The present dispersions are formed by combining the active ingredients in a mixture of the polyalkylene glycol and water under suitable conditions of agitation and temperature control, e.g., at 75°–85° C. The solid gelled sheets are formed from the finished dispersion, e.g., by casting the dispersion onto a suitable moving or stationary surface, as by dipping, spraying or brushing the dispersion onto the surface of a mold, plate or movable belt. See U.S. Pat. No. 3,936,538, the disclosure of which is incorporated by reference herein. The finished sheet may be perforated for division into smaller units, or simply cast into its end-use size. The individual sheets or a strip comprising a plurality of sheets separated by perforations may be packaged, e.g., using protective release sheets, in an appropriate dispensing unit. The present sheets can also be made by coating a cooled metal roller with the reaction mixture and removing the cast sheet with a doctor blade to control its thickness.

Therefore, the aqueous dispersions used to form the present fabric-modifying sheets will comprise, by weight, about 5–30% of at least one water-miscible liquid polyalkylene glycol or methoxypolyalkylene glycol, preferably about 15–25% of a liquid polyethylene glycol; about 40–70%, preferably about 45–60% total water; about 1–10%, preferably about 2.5–7.5% of one or more zwitterionic, preferably betaine, fabric softening agents; about 5–20% gelling agent, preferably about 5–15% of a fatty acid salt; and optionally about 2.5–15% of a surfactant, preferably about 5–10% of nonionio surfactant, and a minor but effective amount of fragrance, e.g. $\leqq 1\%$. The aqueous dispersion may also optionally include about 1–10%, preferably about 1–5% of a polymeric strength-enhancing additive.

With respect to the base sheet of the present invention, the aqueous dispersions used to form the base sheet will comprise, by weight, about 15–25% water-miscible, liquid polyethylene glycol or a liquid monomethoxypolyethylene glycol, about 45–70% total water; about 5–20% gelling agent, preferably an alkali metal stearate; and optionally about 1–12% of a surfactant, preferably about 5–10% of at least one nonionic surfactant, and a minor but effective amount of fragrance, e.g. $\leqq 1\%$. The aqueous dispersion may also optionally include about 0.5–10%, preferably about 1–5% of a strength-enhancing additive such as a PVP polymer or a cationic acrylate. The optional surfactant component may also preferably include a minor but effective amount, e.g., up to about 1% by weight of the total aqueous dispersion, of an anionic surfactant, so as to increase the water-solubility of the sheet.

The invention will be further described by reference to the following detailed examples.

EXAMPLE 1

Fabric-Softening Sheet

Carbowax ® Polyethylene Glycol 400 solvent (polyethylene glycol, M.W.=380–420, 20 g) is added to a beaker equipped with mechanical stirring, followed by 59.2 g of water. The stirred reaction mixture is heated to 80° C., at which point 6.82 g of sodium stearate is added, and mixing continued until it completely dissolves. The temperature is maintained at 80° C. Velvetex ® OLB-50 softener (oleyl betaine, 5.12 g, Henkel, 50% active) is added, and stirring continued for 5 min, until the reaction mixture is homogeneous. Incropol ® CS-12 surfctant (ceteareth-12, 2.68 g) and Monamid CMA ® surfactant (cocamide MEA 5.35 g) are slowly added, followed by 0.8 g of fragrance. After 1-2 minutes of additional stirring, stirring is discontinued.

The reaction mixture is cast into thin sheets by pouring the 80° C. reaction mixture onto a 4.5"×4.5"×1.25" (thick) aluminum block, which is maintained at 25° C. After cooling a flexible fabric softener sheet was obtained that was flexible and could be removed from the block without fracturing.

EXAMPLE 2

Fabric Softener Sheet

A fabric softener sheet was prepared according to the procedure of Example 1, but decreasing the water to 51.04 g and increasing the sodium stearate to 15.0 g.

Test fabrics (towels and sheets) are washed with a 15 min regular wash cycle (warm wash/cold rinse; water level, medium). One softener sheet is placed in the dryer drum with the damp wash and dried for a total of 55 min. After 20 min, the softener sheet is completely consumed and the test fabrics are effectively softened without visible staining or deposition of residue in the drum.

All patents and patent applications cited herein are incorporated by reference herein, as is all technical literature referring to any of the ingredients identified by trademark.

The invention has been described with reference to various specific and preferred embodiments and techniques. However, it should be understood that many variations and modifications may be made while remaining within the spirit and scope of the invention.

WHAT IS CLAIMED IS

1. A fabric-softener comprising a dimensionally stable gelled sheet comprising about 40-70% water, about 5-30% of a water-miscible solvent selected from the group consisting of a liquid polyalkylene glycol, a liquid monomethoxypolyalkylene glycol and mixtures thereof; and an amount of a fatty acid salt gelling agent effective to form a dimensionally gelled stable sheet, having uniformly distributed therein an effective amount of a zwitterionic fabric softening agent; wherein said sheet leaves an insignificant residue in a rotary hot air dryer following a laundry drying cycle.

2. The fabric softener of claim 1 wherein the polyalkylene glycol comprises a liquid polyethylene glycol or a liquid monomethoxypolyethylene glycol.

3. The fabric softener of claim 2 wherein the liquid polyethylene glycol comprises a polyethylene glycol having a molecular weight of 380-420.

4. The fabric softener of claim 1 where the fatty acid salt is sodium stearate.

5. The fabric softener of claim 1 wherein the sheet further comprises about 5-10% of nonionic surfactant.

6. The fabric softener of claim 1 wherein the zwitterionic fabric softening agent is a betaine.

7. The fabric softener comprising a gelled sheet formed by a process comprising:

(a) forming a uniform liquid dispersion of an effective amount of zwitterionic fabric-softening agent, and about 5-20% of a fatty acid salt gelling agent in about 45-60% water and about 15-25% of a liquid, water-miscible polyethylene glycol; and (b) forming the dispersion into a dimensionally stable gelled sheet; wherein said sheet leaves an insignificant residue in a rotary hot air dryer following a laundry drying cycle.

8. The fabric softener of claim 6 wherein the dispersion further comprises an effective amount of fragrance.

9. The fabric softener of claim 6 wherein the gelling agent is an alkali metal fatty acid salt.

10. The fabric modifier of claim 8 wherein the fatty acid salt is sodium stearate.

11. The fabric softener of claim 6 wherein the zwitterionic fabric softening agent is a betaine.

12. The fabric softener of claim 10 wherein the sheet comprises about 2.5-7.5% betaine.

13. The fabric softener of claim 6 wherein the dispersion is heated to about 75°-85° C. in step (a).

14. The fabric softener of claim 6 wherein the dispersion is formed into a dimensionally stable gelled sheet by casting the dispersion into a sheet on a cooled surface.

15. A method for depositing a fabric-modifying agent on fabrics in a rotary hot air dryer comprising placing the fabric softener of claims 1 or 7 in the dryer with the wet fabrics, and operating the dryer to dry to fabrics.

* * * * *